United States Patent [19]

Bryson, Jr.

[11] 4,358,669

[45] Nov. 9, 1982

[54] ELECTRIC HEATING ELEMENTS

[75] Inventor: Charles E. Bryson, Jr., Murfreesboro, Tenn.

[73] Assignee: Emerson Electric Co., St. Louis, Mo.

[21] Appl. No.: 293,156

[22] Filed: Aug. 17, 1981

[51] Int. Cl.[3] ..... H05B 3/06

[52] U.S. Cl. ..... 219/542; 174/174; 219/402; 219/536

[58] Field of Search ..... 219/10, 55 R, 399, 402, 219/403, 408, 532, 536, 542, 546, 548; 174/138 J, 174, 184, 207, 208

[56] References Cited

U.S. PATENT DOCUMENTS

| | | | |
|---|---|---|---|
| 2,438,419 | 3/1948 | Schmidt | 174/174 X |
| 2,540,608 | 2/1951 | Bussmann | 174/208 |
| 3,048,688 | 8/1962 | Drugmand | 219/544 X |
| 3,405,252 | 10/1968 | Lang | 219/399 |
| 4,238,668 | 12/1980 | Mammen | 219/399 |
| 4,264,804 | 8/1981 | Markum | 219/402 |

*Primary Examiner*—Volodymyr Y. Mayewsky
*Attorney, Agent, or Firm*—Michael Williams

[57] ABSTRACT

The invention relates to support legs for bake elements used in microwave ovens. The improved support leg utilizes a conventional wire leg used on bake elements for electric ranges, wherein the leg is formed of wire which is bent to V-shape to provide a bight and legs extending from the bight. Feet are turned outwardly and angularly of the ends of the wire legs, the feet being coined to provide projection welding ridges. A molded ceramic block is slotted to fit into and around the vee and legs of the wire leg, and the two parts are held assembled by welding the feet to the metal sheath of a conventional bake element. The ceramic block is adapted to engage the floor of the microwave oven and is held by the wire leg with sufficient play so that the block may align itself with the oven floor in the event the latter is not level.

5 Claims, 5 Drawing Figures

ELECTRIC HEATING ELEMENTS

BACKGROUND AND SUMMARY

The support leg herein disclosed is an improvement to the leg shown in U.S. Pat. No. 4,264,804, issued on Apr. 28, 1981, to T. Randall Markum, the disclosure of which is incorporated herein be reference.

My invention makes it possible to utilize a conventional wire leg used on bake elements of electric ranges and therefore no additional dies or jigs are needed, since the wire leg in each case is the same, and is projection welded to the metal sheath of the bake element in the same way.

In order to isolate the metal sheath of the bake element from the metal floor of the microwave oven, a small ceramic block is formed with a slot designed to receive the V-shaped part of the wire leg, the latter holding the block in assembled relation when it is projection welded to the metal sheath of the bake element. The block is loosely held so that it may align itself with the floor of the microwave oven in the event the floor is not level.

DESCRIPTION OF THE DRAWING

In the drawing accompanying this specification and forming a part of this application, there is shown, for purpose of illustration, an embodiment which my invention may assume, and in this drawing.

DESCRIPTION OF THE PREFERRED EMBODIMENT

Figure 1:
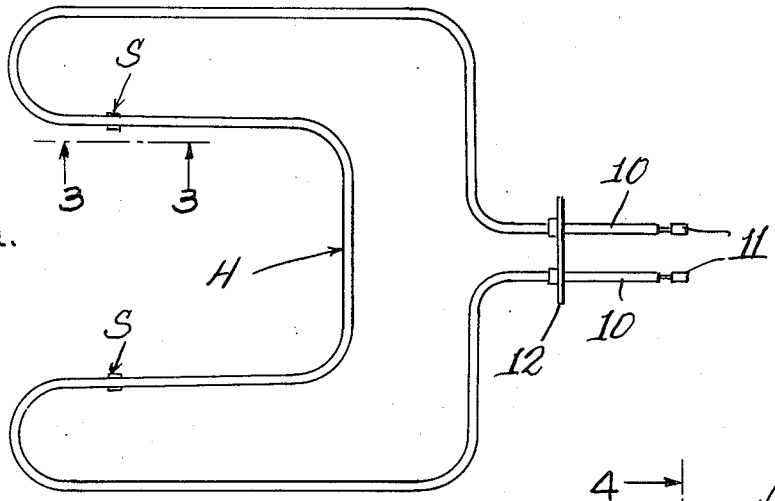
FIG. 1 is a plan view of a conventional bake element for use in microwave oven, drawn to a reduced scale and showing a preferred location of my improved support legs.
Figure 2:
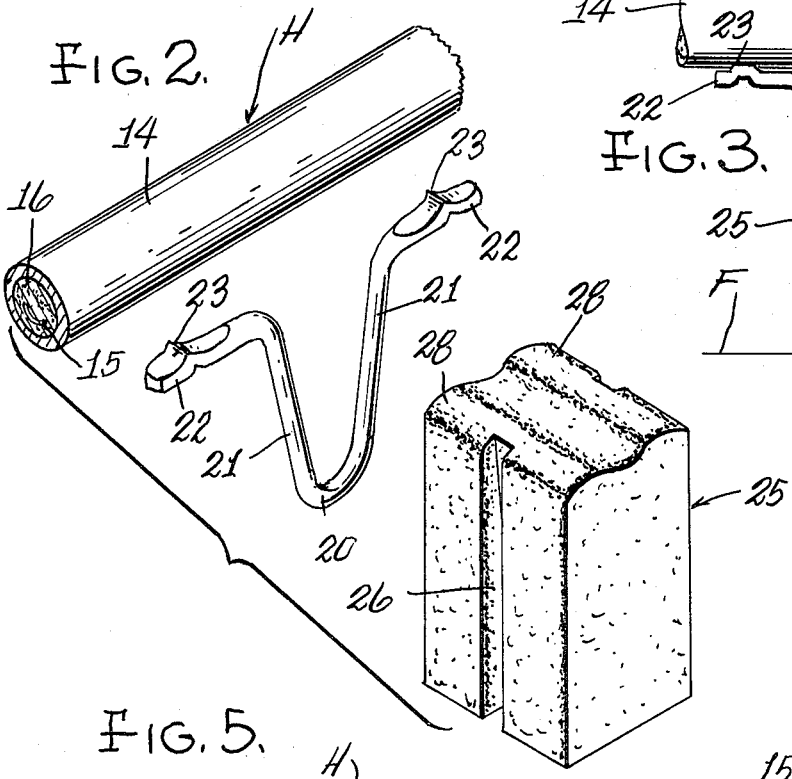
FIG. 2 is an enlarged, separated perspective view of the wire support leg and ceramic block, and a portion of the sheath of the bake element.

The electric heating element H shown in FIG. 1 is of a type commonly used in the ovens of electric ranges, wherein it is arranged for disposition beneath and spaced from the pan or object to be heated in the oven.

A frequent complaint about microwave ovens is that the foodstuff prepared in such oven, although well cooked, does not have a browned appearance. Therefore, conventional bake units were incorporated into microwave ovens and utilized to brown the foodstuff and make it look appetizing.

The conventional bake element used in either electric ovens or microwave ovens is preferably configured as shown in FIG. 1 to provide a considerable heated area within the oven. The element H has terminal legs 10—10 which extend through an opening in the rear wall of the oven (not shown) so that terminals 11—11 may be connected to a source of electrical energy. A bracket 12 is staked securely crosswise of the terminal legs to close the opening in the oven rear wall and to mount the heating element H on the latter.

Figure 4:
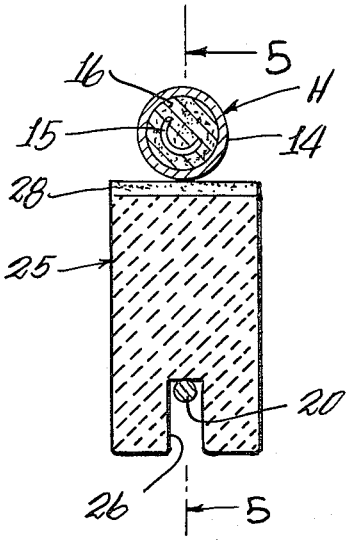
FIG. 4 is a sectional view corresponding to the line 4—4 of FIG. 3.

The bake element herein disclosed comprises a tubular sheath 14 (see FIG. 4) in which a coiled resistance wire 15 is held in centered relation by highly-compacted granular refractory material 16. The element is supported so that it lies parallel and in closely-spaced relation to the metal floor F of the microwave oven. The connection of the mounting bracket 12 with the rear wall of the oven provides a cantilever support for the element, and support standoffs or legs S provide support for the active heating portion of the element.

Each support leg is formed of wire of a diameter of about 0.078 inches (about 1.984 millimeters), which is bent to V-shape to provide a bight 20 and legs 21—21 extending therefrom. The ends of the legs are bent outwardly to form feet 22—22, the feet being subjected to a coining operation to flatten the feet and to provide ridge-like welding projections 23—23 thereon. Support legs of this type are commonly used on bake elements for ovens of conventional electric ranges and are made in large quantities and of a selected number of various heights. Thus, their identical use on bake elements for microwave ovens represents a significant savings in cost.

The only difference between a bake element for an electric oven and a bake element for a microwave oven is that the latter has an insulating member carried by the wire leg to electrically insulate the latter from the metal floor of the microwave oven and to prevent an arcing condition therebetween.

Figure 3:
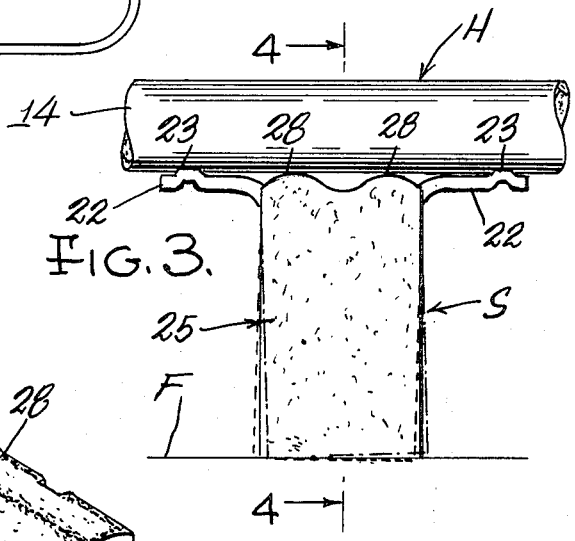
FIG. 3 shows the parts of FIG. 2 in welded, assembled relation, the figure corresponding to the line 3—3 of FIG. 1, but drawn to a larger scale.
Figure 5:
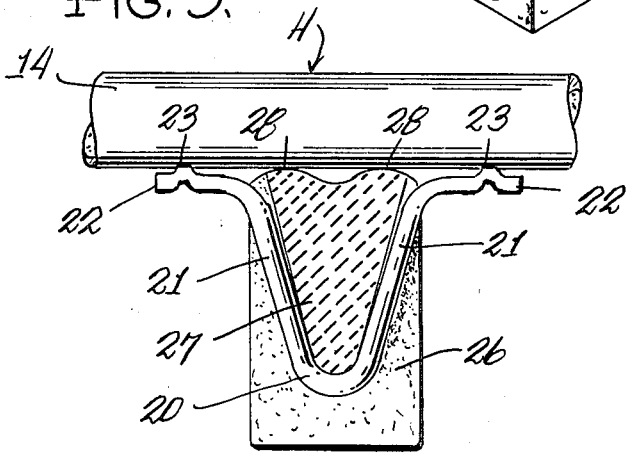
FIG. 5 is a sectional view corresponding to the line 5—5 of FIG. 4.

The insulating member herein disclosed is in the form of an oblong molded block 25, preferably rectangular in horizontal section, and having a vertical slot 26 shaped to receive the bight and legs of the wire support, as best seen in FIG. 5. A V-shaped segment 27 of the block which is left by the slot 26 fits within the V-shaped portion of the wire support and, when the feet 22—22 are projection welded to the metal sheath 14 of the bake element, the ceramic block is held in assembled relation. As seen in FIG. 5, the side surfaces defining the segment 27 do not tightly engage the adjoining surfaces of the wire support legs 21—21 so that the ceramic block may tilt slightly between the dotted lines and dot-dash lines shown in FIG. 3. This permits the block to align itself with the floor of the microwave oven in the event the floor is not level. The top of the ceramic block has a pair of curved surfaces 28—28 to permit the block to rock, while maintaining positive contact between the block and the heating element sheath.

I claim:

1. An electric heating element for browning food in a microwave oven having a metal bottom wall, said heating element comprising an elongated tubular metal sheath, a resistance coil within said sheath and held spaced from the inner wall of the latter by compacted refractory material, said heating element having a terminal portion at an end thereof and an active heating portion inwardly of such end, said terminal portion being connected to a side wall of said oven in cantilever fashion so that said active heating portion closely overlies the bottom wall of said oven, the improvement comprising:

a support for maintaining said active heating portion in predetermined spaced relation above said oven bottom wall, free of arcing between said support and said bottom wall but without mechanical or fused connection therebetween, said support comprising a wire leg shaped to provide a bight and legs extending from said bight, and further comprising a block of rigid insulating material having a bottom surface adapted to engage and rest on said oven bottom wall, said block having a slot opening from said bottom surface and providing a segment interiorly of said block, said slot being of a shape to receive said wire leg with said bight under and around said segment and spaced from said bottom surface sufficiently to prevent arcing between said bight and said oven bottom wall, and said legs extending upwardly on opposite sides of said segment, the free ends of said legs being firmly connected to said sheath in spaced-apart relation to hold said block in position wherein its upper surface is engagable with that part of the sheath between said legs to restrict upward movement of said block and thereby maintain said segment within the confines of said bight and legs.

2. The construction according to claim 1 wherein each of said legs has a welded connection with said sheath.

3. The construction according to claim 1 wherein the free end of each leg has an integral foot extending angularly therefrom and beyond a respective side of said block, each foot being coined to provide a welding ridge for projection welding to said sheath.

4. The construction according to claim 1 wherein said bight and legs loosely surround adjoining surfaces of said segment to permit rocking movement of said block for alignment with said oven bottom wall.

5. The construction according to claim 4 wherein said block upper surface has an upwardly rounded formation engageable with said sheath.

* * * * *